US009457927B2

(12) United States Patent
Kenworthy et al.

(10) Patent No.: US 9,457,927 B2
(45) Date of Patent: Oct. 4, 2016

(54) MULTI-CHAMBER BEVERAGE CONTAINER AND CAP

(71) Applicant: ShotWater, Inc., Pomona, CA (US)

(72) Inventors: Michael Kenworthy, Pomona, CA (US); Nick Trahan, Huntington Beach, CA (US)

(73) Assignee: ShotWater, Inc., Pomona, CA (US)

( * ) Notice: Subject to any disclaimer, the term of this patent is extended or adjusted under 35 U.S.C. 154(b) by 14 days.

(21) Appl. No.: 14/041,732

(22) Filed: Sep. 30, 2013

(65) Prior Publication Data

US 2015/0008241 A1 Jan. 8, 2015

Related U.S. Application Data

(60) Provisional application No. 61/707,908, filed on Sep. 29, 2012.

(51) Int. Cl.

| | |
|---|---|
| ***B65D 1/04*** | (2006.01) |
| ***A47G 19/22*** | (2006.01) |
| *A47G 19/12* | (2006.01) |

(52) U.S. Cl.

CPC ..... *B65D 1/04* (2013.01); *A47G 19/2266* (2013.01); *A47G 2019/122* (2013.01)

(58) Field of Classification Search

CPC ..... B65D 1/04; A47G 2019/122; A47G 19/2266

USPC ..... 222/144.5, 129, 142.2, 142.6–142.8, 222/484, 94

See application file for complete search history.

(56) References Cited

U.S. PATENT DOCUMENTS

| | | | | |
|---|---|---|---|---|
| 2,661,870 | A * | 12/1953 | Huenergardt | B65D 81/3227 215/6 |
| 2,813,649 | A * | 11/1957 | Lipari | A61J 1/2093 206/221 |
| 3,198,394 | A * | 8/1965 | Lefer | B65D 83/68 222/135 |
| 4,585,149 | A * | 4/1986 | Zulauf | B65D 81/3244 222/144.5 |
| 5,353,964 | A | 10/1994 | Liu et al. | |
| 6,164,495 | A * | 12/2000 | Manesis | A61F 9/0008 222/129 |
| 8,083,055 | B2 * | 12/2011 | Simonian | B65D 47/243 206/221 |
| 2003/0160019 | A1 * | 8/2003 | Blanding | A61J 9/00 215/11.1 |
| 2004/0188462 | A1 | 9/2004 | Decottignies et al. | |
| 2006/0102581 | A1 | 5/2006 | Yates | |

OTHER PUBLICATIONS

International Search Report and Written Opinion of The International Searching Authority for Application No. PCT/US2014/058477, dated Jan. 7, 2015 (8 pp.).

* cited by examiner

*Primary Examiner* — Kevin P Shaver
*Assistant Examiner* — Robert Nichols, II
(74) *Attorney, Agent, or Firm* — Zeller IP Group, PLLC; Kyle M. Zeller

(57) ABSTRACT

A novel container is described having an outer chamber adapted to hold an amount of a first liquid; an inner chamber displaced within the outer chamber, the inner chamber adapted to hold an amount of a second liquid; and a cap having a mouthpiece adapted to allow the first liquid and second liquid to flow therethrough. The cap may be adapted to allow passage of the first liquid, but not the second liquid, when the mouthpiece is in a first position. The cap may also be adapted to allow passage of the second liquid, but not the first liquid, when the mouthpiece is in a second position.

1 Claim, 8 Drawing Sheets

FIG. 4A
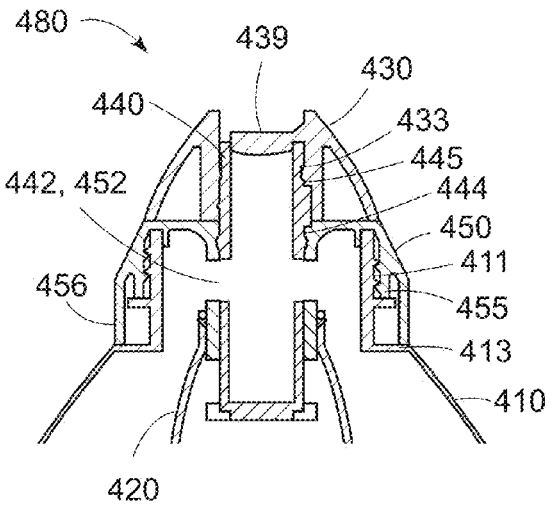
FIG. 4B
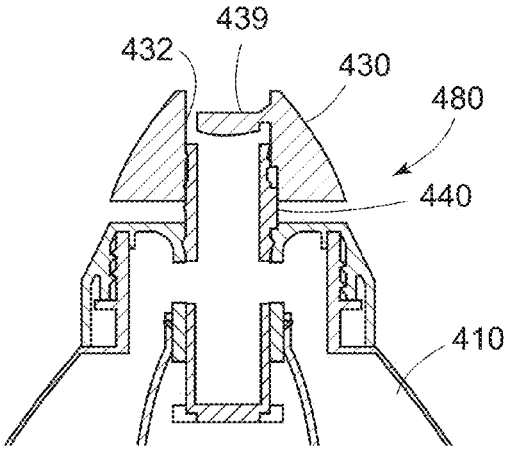
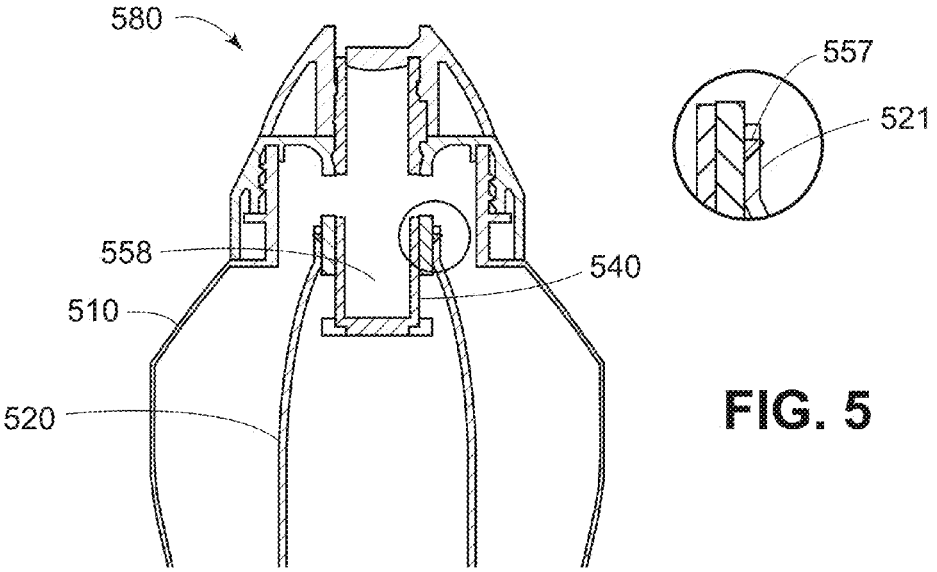
FIG. 5

MULTI-CHAMBER BEVERAGE CONTAINER AND CAP

CROSS-REFERENCE TO RELATED APPLICATIONS

The present application claims benefit of U.S. provisional patent application Ser. No. 61/707,908, titled "Three-Way Bottle Cap Drinking System" filed Sep. 29, 2012, which is incorporated by reference herein in its entirety.

FIELD OF THE INVENTION

The present disclosure relates generally to apparatuses and methods for dispensing liquids. More particularly, the disclosure pertains to containers and container caps for dispensing multiple liquids, such as but not limited to water and a nutritional or vitamin-enriched liquid supplement, from a single container.

BACKGROUND

The beverage industry provides any number of drink options to consumers, including at least soda, water, tea, milk, sports drinks and functional liquid supplements. However, no product in the beverage industry contains multiple different and separate substances within the same container and utilizes a bottle cap that permits the consumer to separately consume different substances contained within the same container.

More specifically, there are many options within the enhanced functional beverages market, including, for example, sports, fitness and other health and wellness beverages (collectively, "sports drinks") and functional, nutritional or vitamin-enriched liquid supplements (collectively, "supplement shots"). Generally, sports drinks are sold to consumers in much larger bottles (e.g., 12, 16, 24, or 32 ounce bottles) relative to supplement shots (e.g., 1, 2 or 4 ounce bottles). However, consistent with the beverage industry generally, no product in the enhanced functional beverages market contains a sports drink and a supplement shot within the same bottle and utilizes a bottle cap that permits the consumer to select either a sports drink or a supplement shot contained within the same bottle.

As a result of the foregoing, consumers who wish to drink multiple beverages must purchase multiple products, each consisting of a single beverage contained within a bottle having its own bottle cap. Companies must therefore manufacture and produce multiple bottles and bottle caps, rather than a single bottle and bottle cap, creating a greater environmental impact.

Moreover, supplement shots and certain other products in the beverage industry may be highly concentrated beverages infused with vitamins, supplements and other nutrients, having a strong, sour or sweet taste. A consumer wishing to offset the taste of a supplement shot must purchase a separate beverage and consume the same immediately after drinking the supplement shot.

Accordingly, there is a need in the art for a product that reduces costs to consumers who simultaneously purchase multiple beverages (e.g., a sports drink and supplement shot), minimizes the environmental impact of manufacturing and producing multiple bottles and bottle caps to supply such purchases, and increases the palatability of highly-concentrated beverages. It would be beneficial if a single bottle contained multiple, separate liquids, such as a sports drink and a supplement shot, and each liquid could be consumed by a consumer at a single time.

SUMMARY OF THE INVENTION

In accordance with the present invention, an improved container with container cap is provided. Methods and systems are provided herein for drinking, in the alternative, a first or second liquid from a single container comprising an inner container seated within an outer container. The consumer may actuate the bottle cap, such as by pulling, pushing, and/or twisting, to select the first liquid or second liquid.

In one aspect of the invention, a container is provided having a hollow outer chamber with an opening at the top thereof and adapted to hold an amount of a first liquid. A hollow inner chamber may be displaced within the outer chamber, and the inner chamber may have an opening at the top thereof and be adapted to hold an amount of a second liquid. The container may include a cap having a mouthpiece adapted to be placed in the mouth of a user. The mouthpiece may include a top surface having an aperture therein, an open bottom surface, and an outer wall extending from the aperture of the top surface to the opening of the bottom surface defining a channel. The cap may also include a middle section having a top end attached to the mouthpiece, a bottom end, and a hollow wall extending from the first end to the second end defining a channel. The middle section wall may include a top aperture adapted to allow a liquid to pass through the middle section channel to reach the open bottom of the mouthpiece. The middle section may also have a bottom aperture adapted to allow liquid to pass into the middle section channel from the inner container or outer container. The cap may also include an outer container base having a top end attached to the bottom end of the middle section, a bottom end attached to the outer container opening, and a hollow cylindrical structure extending between the top end and bottom end. The cylindrical structure may be adapted to receive at least a portion of the middle section therein. At least a portion of the outer container base cylindrical structure may be disposed within the outer container and may have an opening adapted to allow the first liquid to pass therethrough. The cap may also include an inner container base having a top end attached to the bottom end of the outer container base, a bottom end attached to the inner container opening, and a hollow cylindrical structure extending between the top end and bottom end. At least a portion of the inner container base cylindrical structure may be disposed within the inner container and may include an opening adapted to allow the first liquid to pass therethrough. The cap may be adapted to allow passage of the first liquid, but not the second liquid, when the mouthpiece is in a first position. The cap may also be adapted to allow passage of the second liquid, but not the first liquid, when the mouthpiece is in a second position.

In another aspect of the invention a container is described having an outer chamber adapted to hold an amount of a first liquid; an inner chamber displaced within the outer chamber, the inner chamber adapted to hold an amount of a second liquid; and a cap having a mouthpiece adapted to allow the first liquid and second liquid to flow therethrough. The cap may be adapted to allow passage of the first liquid, but not the second liquid, when the mouthpiece is in a first position. The cap may also be adapted to allow passage of the second liquid, but not the first liquid, when the mouthpiece is in a second position.

These and other aspects of the invention may be more clearly understood by reference to the following detailed description of the invention and the appended claims.

BRIEF DESCRIPTION OF THE DRAWINGS

The preferred embodiments of the present invention are illustrated by way of example and are not limited to the following figures.

FIG. 4A shows a cross-sectional view of an exemplary cap 480 comprising a mouthpiece 430 in a closed position.

FIG. 4B shows a cross-sectional view of an exemplary cap 480 comprising a mouthpiece 430 in an open position.

FIG. 5 shows a cross-sectional view of an exemplary cap 580 with a close-up view of a connection between an exemplary cap middle section 540 and inner container 520.

DETAILED DESCRIPTION

Various embodiments and aspects of the invention will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Exemplary containers comprising an inner container having a first liquid disposed therein and an outer container having a second liquid disposed therein are described. Caps adapted to connect to such containers are described, allowing a user to consume either the first liquid or second liquid. As described in detail below, a user may actuate (e.g., twist, push, and/or pull) an inventive cap connected to an exemplary multi-chamber container to select either the first or second liquid for drinking. The user may alternate between the first and second liquid, or may consume the entire first liquid before switching the cap to consume the second liquid. In alternative embodiments, the user may consume both the first liquid and second liquid simultaneously.

Figure 1:
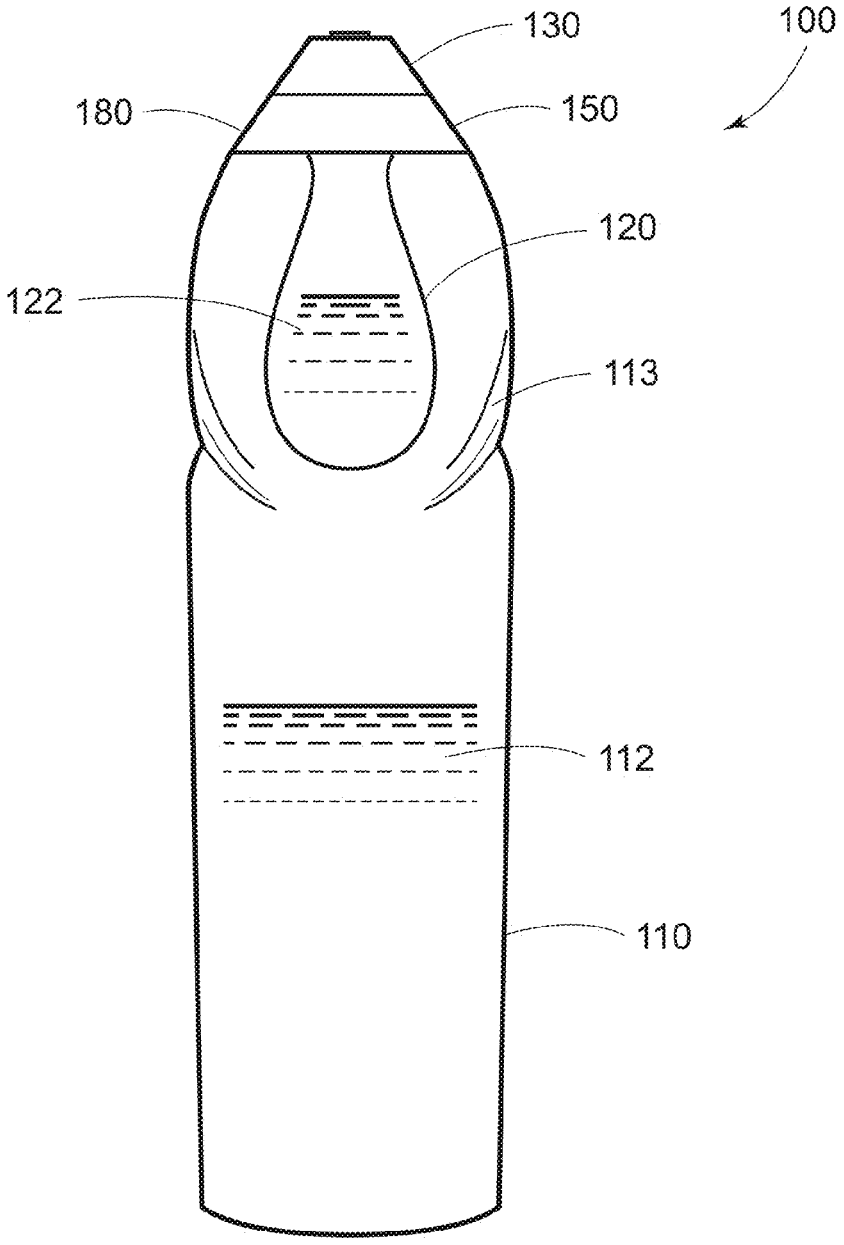
FIG. 1 shows a perspective view of an exemplary container 100.

Referring to FIG. 1, an exemplary container 100 is shown to comprise an outer container 110 having an inner container 120 disposed therein. The container 100 is shown to comprise a cap 180 attached to the top portion thereof, and the cap is shown to comprise a base portion 150 connected to a mouthpiece 130. As discussed in detail below, liquid 122 from the inner container 120 and/or liquid 112 from the outer container 110 may pass from the respective container through an orifice in the mouthpiece 130 such that it may be consumed by a user.

The outer container 110 may comprise any rigid or flexible material employed in the production of bottles, pouches or cans, such as but not limited to plastic, glass, metal (e.g., aluminum) or any other material. The shape of the outer container 110 may vary, but may be suitable to hold a liquid or liquid-like substance, gel or gel-like substance, semi-liquid or semi-liquid-like substance, or any other substance that can flow. The outer container 110 may be sized to hold from about 8 fluid ounces to about 32 fluid ounces. For example, the outer container 110 may hold about 8 fluid ounces, about 10 fluid ounces, about 12 fluid ounces, about 16 fluid ounces, about 24 fluid ounces, or about 32 fluid ounces.

In one embodiment, the outer container 110 may be at least partially transparent such that, if a liquid 112 held therein is also at least partially transparent, the inner container 120 may be viewable. Moreover, in certain embodiments, the outer container 110 may comprise a grip 113 to allow a user to easily hold the container while engaged in activity such as walking, running or bike riding. The grip may typically comprise the same material as the outer container, but may alternatively or additionally comprise a rubber or other material having a higher coefficient of friction.

As shown, the outer container 110 may comprise a first liquid 112, which may comprise any liquid, such as but not limited to: water, flavored water, juice or pressed juices, soda or other carbonated beverages, sports drinks, shampoos and hair products, oils milk or any other liquid. In a preferred embodiment, the first liquid 112 is water or flavored water that may be consumed immediately after consumption of a supplement shot 121 to "chase" or dilute the flavor of the same.

The inner container 120 may comprise any rigid or flexible material employed to produce bottles, pouches or cans, such as but not limited to plastic, glass, metal (e.g., aluminum) or any other material. The inner container 120 may comprise any shape suitable for being disposed within the larger outer container 110 while allowing the flow of the first liquid 112 from the outer container 110 to the mouthpiece 130. In one example, the inner container 120 may comprise a spherical or teardrop-type shape. In any event, the shape and material of the inner container 120 may be suitable to hold a liquid or liquid-like substance, gel or gel-like substance, semi-liquid or semi-liquid-like substance, or any other substance that can flow.

The inner container 120 may be sized to hold from about 0.5 fluid ounces to about 16 fluid ounces. For example, the inner container 120 may hold about 0.5 fluid ounces, about 1 fluid ounce, about 1.5 fluid ounces, about 2 fluid ounces, about 2.5 fluid ounces, or about 3 fluid ounces.

As shown, the inner container 120 may comprise a second liquid 122, which may comprise any edible liquid such as but not limited to: functional or nutritional supplement shots, alcoholic shots, water, flavored water, juice or pressed juices, soda or other carbonated beverages, shampoos and hair products, oils, milk or any other liquid. The second liquid 122 may be referred to herein as a "supplement shot," as a user may choose to drink the second liquid in similar fashion to the way one would drink an alcoholic "shot." That is, the user may drink the supplement shot in one or more gulps.

The container 100 is shown to comprise a cap 180, which when attached to the container, can prevent both the first liquid 112 and second liquid 122 from exiting the same. The cap 180 may comprise at least a base 150 and mouthpiece 130 through which the first liquid 112 and/or second liquid 122 may travel to reach the mouth of a user. The cap 180 may comprise any type of closure, including a push-pull cap, a twist cap, a pry cap, or another type of closing mechanism.

Figure 2:
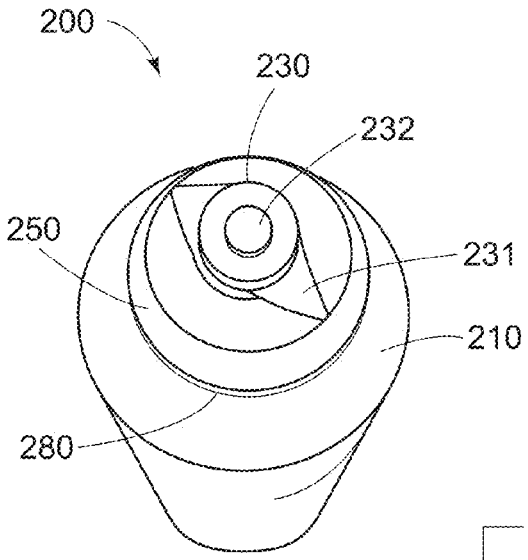
FIG. 2 shows a top perspective view of an exemplary container 200.

FIG. 2 illustrates a top perspective view of an exemplary container 200 having a cap 280 attached thereto. As shown, the cap 280 comprises a mouthpiece 230 and base section 250 having an aperture 232 extending therethrough. The mouthpiece 230 may be adapted to be placed in a user's mouth such that one or more liquids may be displaced from within the container 200, through the mouthpiece 230 and into the mouth.

In one embodiment, the mouthpiece may comprise wings or grips 231 that may be gripped by the fingers, lips or teeth of a user. Using the wings 231, a user may turn the mouthpiece 230 in relation to the container 210 to open or close the container. A user may also grip the wings 231 in order to push or pull the mouthpiece 230 inward or outward with respect to the container 200 such that a flow of liquid from the container may be started or stopped.

The mouthpiece 230 may be removably or permanently attached to a base portion 250 of the cap 280, and the base may be removably or permanently attached to the inner and/or outer container of an exemplary container 200, as discussed in detail below. In an alternative embodiment, a user may actuate the base 250 (e.g., twist, turn, rotate, push and/or pull) in order to open or close the container.

Figure 3:
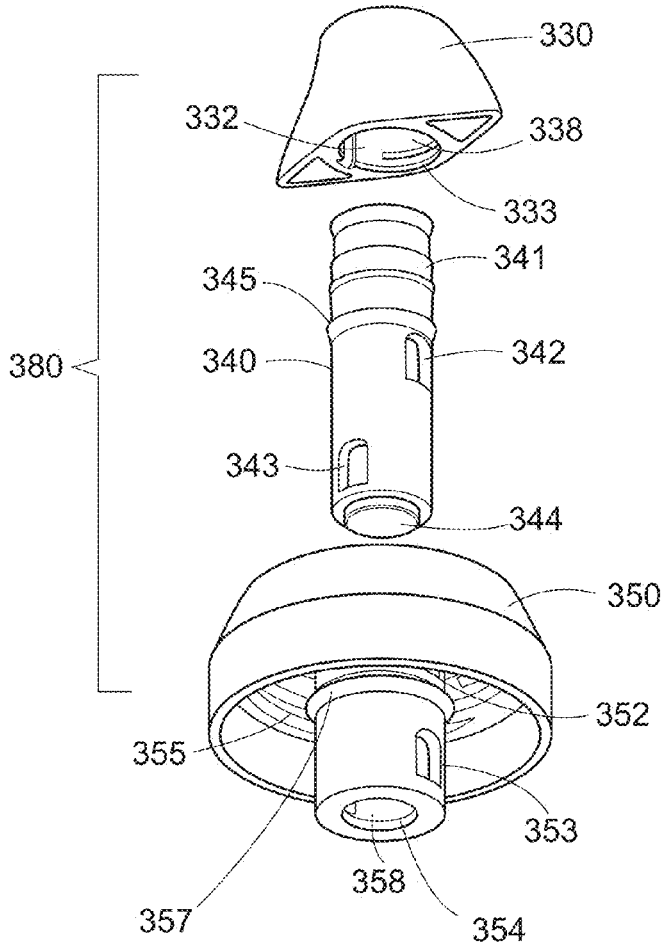
FIG. 3 shows an exploded view of an exemplary cap 380 comprising a mouthpiece 330, middle section 340, and base 350.

Referring to FIG. 3, an exploded view of an exemplary cap 380 comprising a mouthpiece 330, middle section 340, and base 350 is illustrated. As shown, the mouthpiece 330 may be permanently or removably attached to a middle section 340, which is in turn permanently or removably attached to a base 250.

The mouthpiece 330 is shown to comprise a bottom surface and top surface having a channel 338 extending therethrough. The channel 338 is adapted to allow the passage of one or more liquids from a container attached to the cap 380. The channel also comprises a track 333 (e.g., threading, projection, snap-fit, or depression) that is adapted to fit to a complementary track 341 (e.g., threading, projection, snap-fit, or depression) of a middle section 340. For example, the mouthpiece 330 and middle section 340 may snap together in such a way as to prevent the two pieces from being separated during the course of normal use (e.g., via snap fit 345 or the like).

A middle section 340 is adapted to allow one or more liquids to pass from the base 350 to the mouthpiece 330. As shown, the middle section 340 comprises a hollow shape adapted to receive liquid from an inner container and/or outer container and allow the same to travel therethrough to the mouthpiece 330. For example, the middle section may comprise a tubular or cylindrical outer wall forming a channel.

In one embodiment, when the mouthpiece 330 and middle section 340 are attached, the mouthpiece can move upward and downward with respect to the middle section. The middle section may comprise a rim or other stopper 341 that creates a liquid-tight seal with the track 333 of the mouthpiece when pushed together. In this way, a user can "open" the cap to allow liquid to flow from the container by pulling the mouthpiece away from the middle section and/or can "close" the cap to prevent liquid from flowing by pushing the mouthpiece toward the middle section. In an alternative embodiment, the mouthpiece 330 may be rotated about the middle section 340 to "open" and "close" an aperture to allow or prevent the flow of a liquid.

The middle section 340 is shown to comprise an upper aperture 342 and lower aperture 343. Although not shown, the upper aperture 342 may comprise a set of apertures (e.g., a first upper aperture and second upper aperture) located approximately opposite to each other (i.e., about 180 degrees about the outer wall of the middle section 340). Similarly, the lower aperture 343 may comprise a set of apertures (e.g., a first lower aperture and second lower aperture) located approximately opposite each other (i.e., about 180 degrees about the outer wall of the middle section 340).

As shown, the upper aperture 342 may be located a vertical distance away from the lower aperture 343, towards the mouthpiece 330. In other words, the lower aperture 343 may be located a vertical distance away from the upper aperture 342, towards the base 350. The upper aperture 342 may be located approximately 90 degrees about the outer wall of the middle section 340 with respect to the lower aperture 343. Accordingly, in a situation where there are a pair of upper apertures 342 and a pair of lower apertures 343, each lower aperture will be located approximately 90 degrees about the outer wall of the middle section 340 with respect to any lower aperture 343.

The middle section is also shown to comprise a snap fit 344 or other means of rotatably securing the middle section 340 to a base 350. As shown, the middle section 340 may be rotated with respect to the base 350 when connected thereto, but may not be pulled or pushed upward or downward with respect to the base.

In the pictured embodiment, the mouthpiece 330 may not be capable of rotating with respect to the middle section 340. Rather, the middle section is rotated with the mouthpiece when it is rotated. As discussed in detail below, the rotation of the middle section 340, such as by gripping and rotating the mouthpiece 330, does not rotate the base 350 and so allows for selection of liquid from either the outer container or inner container.

An exemplary base 350 may comprise a channel 358 adapted to receive a middle section 340 therein. As shown, the base comprises a snap fit 354 or other connection means to rotatably secure the middle section 340 to the base 350. A middle section may be inserted therein and prevented from being pulled or pushed upward or downward with respect to the base, but may be able to be rotated with respect to the base.

The base 350 is shown to comprise an upper base aperture 352 and lower base aperture 353. Although not shown, the upper base aperture 352 may comprise a set of apertures (e.g., a first upper base aperture and second upper base aperture) located approximately opposite to each other (i.e., about 180 degrees about the outer wall defining the channel 358 of the base 350). Similarly, the lower base aperture 353 may comprise a set of apertures (e.g., a first lower base aperture and second lower base aperture) located approximately opposite each other (i.e., about 180 degrees about the outer wall defining the channel 358 of the base 350).

As shown, the upper base aperture 352 is located a vertical distance away from the lower base aperture 353 and towards the middle section 340. In other words, the lower base aperture 353 is located a vertical distance away from the upper base aperture 352 and towards the bottom of base. The upper base aperture 352 is located on the same side of the channel 358 with respect to the lower base aperture 353. Accordingly, in a situation where there are a pair of upper base apertures 352 and a pair of lower base apertures 353, each lower aperture will be located approximately 90 degrees about the circumference of the outer wall defining the channel 358 with respect to any lower base aperture 353.

The upper base aperture 352 may be located on the same horizontal plane as the middle section upper aperture 342 when the middle section is inserted into the base channel 358. The upper apertures 342, 352 may be located within an outer container, but not within an inner container of an exemplary multi-chamber container, when the cap is connected thereto.

The lower base aperture 353 may be located on the same horizontal plane as the middle section lower aperture 343 when the middle section is inserted into the base channel 358. The lower apertures 343, 353 may be located within an inner container, but not within an outer container of an exemplary multi-chamber container, when the cap is connected thereto.

In one embodiment the upper aperture 342 of the middle section and the upper base aperture 352 may be of similar or complementary size and shape. For example, the apertures may be ¼ inches high and 3/16 inches wide. In other embodiments, the upper apertures may be different sizes, so long as liquid may pass through them when they are aligned.

In one embodiment the lower aperture 343 of the middle section and the lower base aperture 353 may be of similar or complementary size and shape. For example, the apertures may be ¼ inches high and 3/16 inches wide. In other embodiments, the lower apertures 343, 353 may be different sizes, so long as liquid may pass through them when they are aligned.

The middle section 340 may be rotatably inserted into the base channel 358 such that a user may rotate the middle section with respect to the base or may rotate the base with respect to the middle section. As discussed in detail below, when the base is connected to an exemplary container comprising an inner container and outer container, the upper aperture 342 of the middle section may be aligned with the upper base aperture 352 to allow the flow of liquid from the outer container. In this configuration, the lower aperture 343 of the middle section will not be aligned with the lower base aperture 353 and so liquid will not flow from the inner container. A user may change the configuration by rotating the middle section 340 or the base 350 such that the lower apertures 343, 353 are aligned and the upper apertures 352, 342 are not aligned, thus allowing liquid to flow from the inner container, but not the outer container.

As shown, an under side of the base 350 may comprise a threading 355 or other means of attaching the base to an outer container. Additionally or alternatively, the base may comprise a snap fit 357 or other attachment means for attaching the base to an inner container. For example, the base may be attached to a container such that a portion of the base channel 358 comprising a lower aperture 353 may be displaced within an inner container (but not within the outer container), and a portion of the base comprising an upper aperture 352 may be displaced within an outer container (but not within the inner container).

It will be appreciated that although the pictured embodiment shows the middle section 340 to have a lower aperture 343 on a different vertical plane than the upper aperture 342 (i.e., offset 90 degrees about the circumference of the outer wall of the middle section) and a base 350 with a lower base aperture 353 on the same vertical plane as the upper base aperture 352, the positions may be reversed. For example, an alternative embodiment may comprise a middle section 340 having a lower aperture 343 on the same vertical plane as an upper aperture 342 and a base 350 with a lower base aperture 353 on the a different vertical plane than the upper base aperture 352 (i.e., offset 90 degrees about the circumference of an outer wall defining the channel of the base). Moreover, the horizontal degrees of offset are not particularly limited as long as a user can select to either line up the upper apertures (342, 352) or lower apertures (343, 353) of a base and mouthpiece.

Referring to FIG. 4A, a cross-sectional view of an exemplary cap 480 comprising a mouthpiece 430 in a closed position is illustrated. As shown, the track 433 of the mouthpiece 430 may be secured to a complementary track 445 of a middle section 440. The mouthpiece 430 is shown in a "closed" position, as a stopper 439 of the mouthpiece is flush to the middle section 440, thus preventing liquid from passing through the mouthpiece. For example, the mouthpiece may be pushed or twisted downward toward the middle section.

The middle section 440 is also shown to be secured to the base 450 via a thread or complementary snap fit of the middle section 444 and base 454. In this configuration, an upper aperture 442 of the middle section may be aligned with an upper base aperture 452 and liquid may pass from an outer container 410 through the middle section 440 and into the mouthpiece 430. Although not shown, a lower aperture of the middle section and the lower base aperture may be located within the inner container 420 and are not aligned. Accordingly liquid in the inner container 420 cannot pass into the middle section 340 or mouthpiece 430.

The base 450 may be secured to the outer container via a complementary threading of the base 455 and outer container 411. Moreover, a rim 456 of the bottom side of the base 450 may rest on a ledge 413 on the outer surface of the outer container 410 to prevent the base from being pushed downward with respect to the container.

Referring to FIG. 4B, a cross-sectional view of an exemplary cap 480 comprising a mouthpiece 430 in an open position is illustrated. The mouthpiece is shown in an "open" position, as a stopper 439 of the mouthpiece is not flush to the middle section 440, thus allowing liquid to pass through an aperture 432 in the mouthpiece. For example, the mouthpiece 430 may be pushed or twisted away from the middle section 440. Accordingly, in the pictured configuration, liquid passing from the outer container 410 may pass through the middle section 440 and the mouthpiece 430 and into the mouth of a user.

Referring to FIG. 5, a cross-sectional view of an exemplary cap 580 with a close-up view of a connection between an exemplary cap middle section 540 and inner container 520 is illustrated. As shown, a threading, track or snap fit of the inner container 521 may be attached to a complementary threading, track or snap fit of a base 557. The base 550 may therefore be secured to the inner container 520 such that at least a portion of the base (e.g., base channel 558 and lower aperture (not shown)) extends into the inner container.

Figure 6:
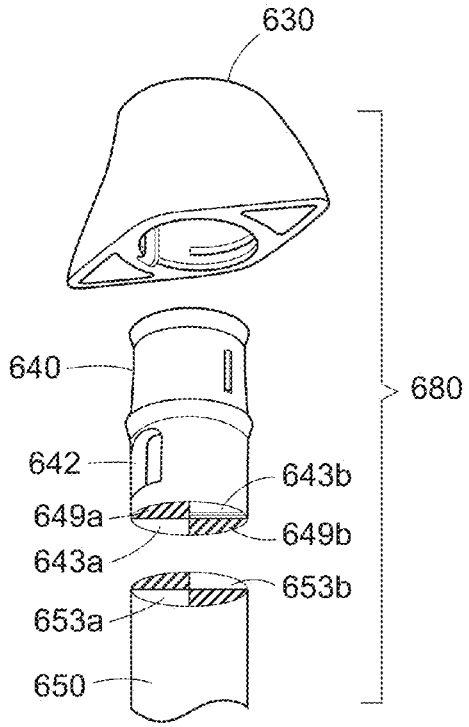
FIG. 6 shows an exploded view of an alternative embodiment of a cap 680.

Referring to FIG. 6, an alternative embodiment of a cap 680 is illustrated. As shown, the cap 680 may comprise a mouthpiece 630, middle section 640 and base 650.

The pictured embodiment shows an alternative, horizontal configuration for the lower aperture 643*a,b* of the middle section 640. As shown, the bottom surface of the middle section may comprises a fan-blade-type configuration comprising a pair of lower apertures 643*a,b* located adjacent to solid blades 649*a,b*.

The base 650 may comprise a complementary pair of apertures 653*a,b*. When the middle section 640 is rotatably connected to the base 650, the lower apertures 643*a,b* may be rotated into alignment with the base aperture 653*a,b* to allow liquid to flow therethrough. However, when the lower apertures 643*a,b* are not in alignment with the base apertures 653*a,b*, liquid may not pass through. Accordingly, when at least a portion of a channel of a base 650 is displaced within an inner container, liquid may be passed from the inner container through the middle section 640 and mouthpiece 630 to the mouth of a user by rotating the middle section.

As shown, the upper aperture 642 is located a vertical distance away from the lower apertures 643*a,b* and towards the mouthpiece 630. The upper aperture 652 is also located on a different vertical plane from the lower apertures 643*a,b*. In other words, the upper aperture 642 is located about 90 degrees about the circumference of the outer wall of the middle section away from both lower apertures 643*a,b*. Accordingly, when the mouthpiece 630 and middle section 640 are rotated to close the lower apertures 643*a,b*, the upper aperture 642 may be open.

As an example, a solid window piece (not shown) may engage to cover the upper aperture 642 when the lower apertures (643*a,b* and 653*a,b*) are aligned. The window piece may disengage to allow the upper aperture 642 to be open when the lower apertures (643*a,b* and 653*a,b*) are not aligned.

Figures 7A, 7B, 7C:
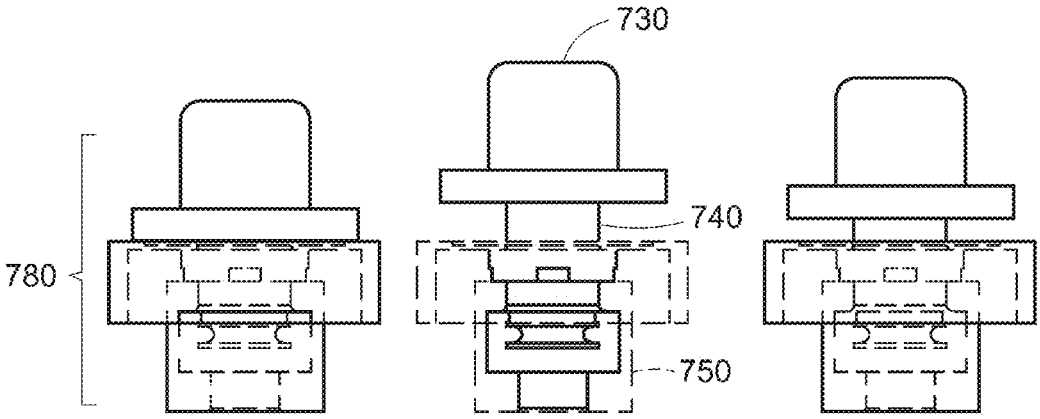
FIGS. 7A-7C respectively show cross-sectional views of an exemplary cap 780 in a first, downward position where a liquid in an inner container can flow through the mouthpiece 730; a second, extended position where a liquid in an outer container can flow through the mouthpiece 730; and a third, neutral position where no liquid flows through the mouthpiece 730.

Referring to FIG. 7A-7C, an alternative embodiment of a cap 780 is illustrated with mouthpiece 730 in three positions. In FIG. 7A, the mouthpiece 730 is shown in a downward position to allow a liquid from an inner container to pass therethrough. In FIG. 7B, the mouthpiece is shown in an extended or upward position to allow a liquid from an outer container to pass therethrough. In FIG. 7C the mouthpiece is shown in a neutral position to prevent any liquid from passing therethrough.

As shown, the cap 780 may comprise a mouthpiece 730, middle section 740 and base 750.

Figure 8A:
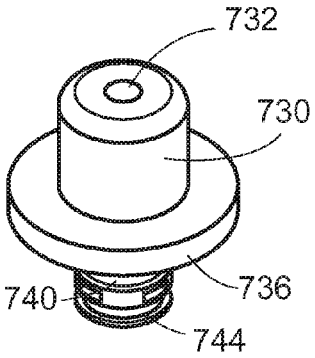
FIGS. 8A-8C respectively show a top perspective view, a cross-sectional view, and a bottom perspective view of a mouthpiece 730 and middle section 740 of cap 780 shown in FIGS. 7A-7C.
Figure 8B:
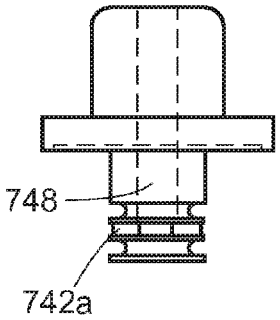
Figure 8C:
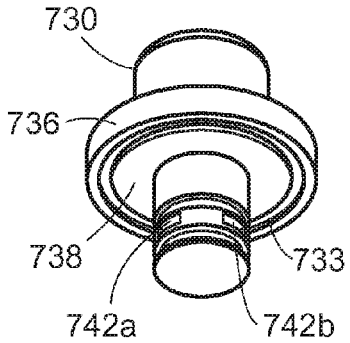

Referring to FIGS. 8A-8C, a top perspective view, cross-sectional view, and bottom perspective view of the cap 780 of FIGS. 7A-7C are illustrated, respectively. The mouthpiece 730 is shown to be connected to a middle section 740. The mouthpiece comprises an aperture 732, and a channel 748 runs from the aperture to one or more aperture 742*a,b* of the middle section 740. The mouthpiece comprises a rim 736 that attaches via a track or snap-fit 733 on its bottom side, to an outer container of an exemplary container comprising an inner and outer container. The mouthpiece further comprises a track or snap-fit 738 for attaching the mouthpiece to a base 750.

As shown, the middle section comprises a hollow cylindrical shape with an outer wall defining a channel 748. The middle section 740 comprises one or more apertures (e.g., a pair of apertures 742*a,b* located a horizontal distance apart). The middle section comprises a snap-fit, track, or other attachment means 744 for attaching the cylindrical middle section within a channel 758 of a base 750.

Figure 9A:
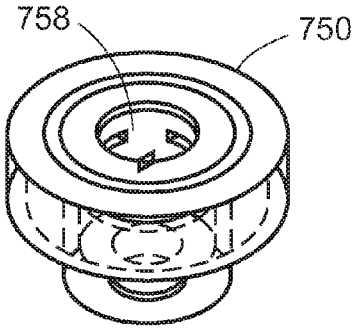
FIG. 9A-9B respectively show a top perspective view and a bottom perspective view of a base portion 750 of cap 780 shown in FIGS. 7A-7C.
Figure 9B:
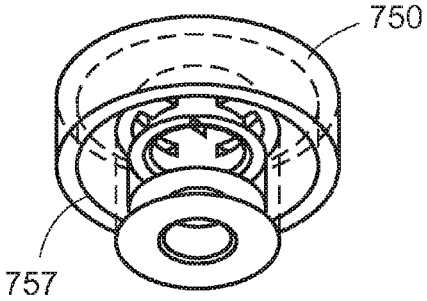

Referring to FIGS. 9A and 9B, a top perspective view and bottom perspective view of an exemplary base of the cap 780 of FIGS. 7A-7C are illustrated, respectively. As shown, the base 750 comprises a channel 758 adapted to receive the middle section 740 and prevent the same from rotating in relation to the base 750. Rather, the base channel 758 comprises an internal structure that allows the middle section 740 to be pulled upward or pushed downward in relation to the base.

The base 750 comprises a rim 757 which may comprise a snap-fit or track (not shown) on its bottom surface for attaching the base to an inner container of an exemplary container comprising an inner container and outer container. The base 750 is adapted such that at least a portion thereof is seated within an inner container when it is attached to a container comprising an inner container and outer container.

When the mouthpiece 730 is placed in the downward position of FIG. 7A, the middle section apertures 742*a,b* may be located within an inner container (but not within an outer container) when the cap 780 is attached to a container comprising an outer container and inner container. The interior wall of the base channel 758 is configured as not to block the middle section aperture 742*a,b* in this position, and accordingly, liquid may flow from an inner container, through the apertures, into the middle section channel 748 and out through an aperture 732 of the mouthpiece.

When the mouthpiece 730 is seated in the extended position of FIG. 7B, the middle section apertures 742*a,b* may be located within an outer container (but not within an inner container) when the cap 780 is attached to a container comprising an outer container and inner container. The interior wall of the base channel 758 is configured as not to block the middle section aperture 742*a,b* in this position, and accordingly, liquid may flow from an outer container, through the apertures, into the middle section channel 748 and out through an aperture 732 of the mouthpiece.

When the mouthpiece 730 is seated in the neutral position of FIG. 7C, the middle section apertures 742*a,b* are blocked by the walls of the base, and no liquid may pass through. It will be appreciated that a user may push or pull the cap from a first position to a second position or third position as desired to consume a first liquid, second liquid or to close the cap.

Figure 10B:
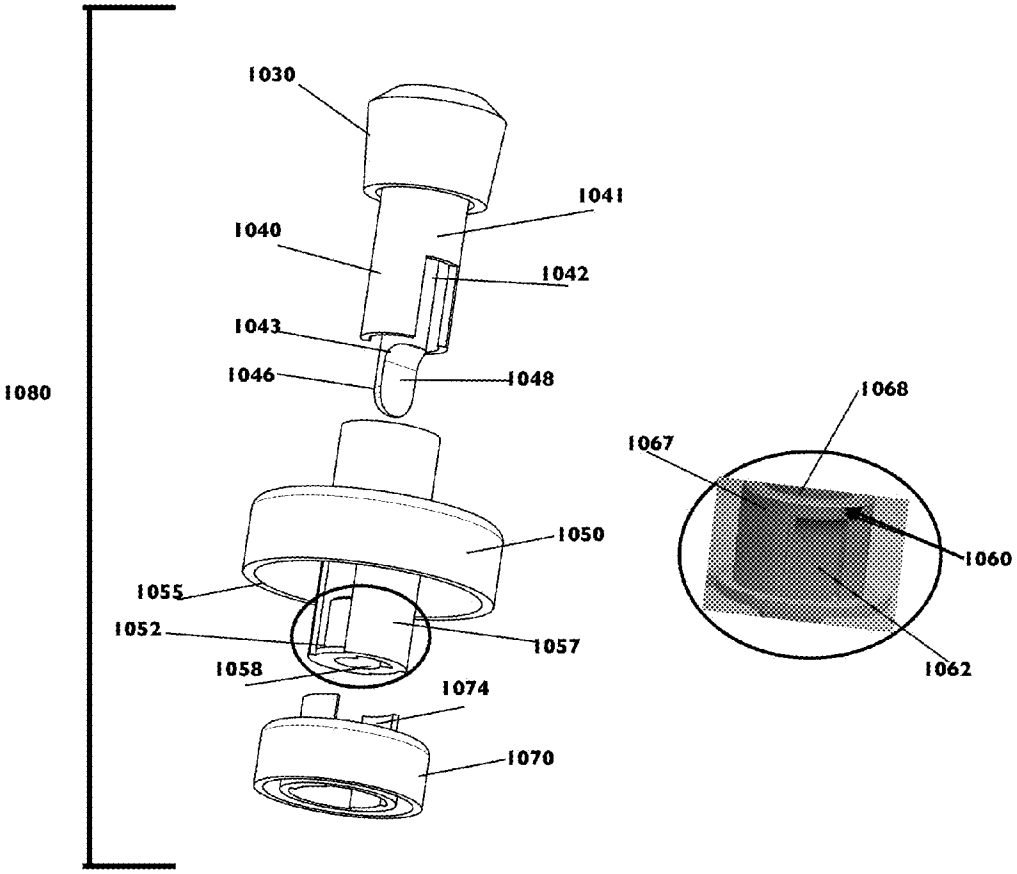
FIG. 10B shows an exploded view of the exemplary cap 1080 of FIG. 10A.
Figure 10A:
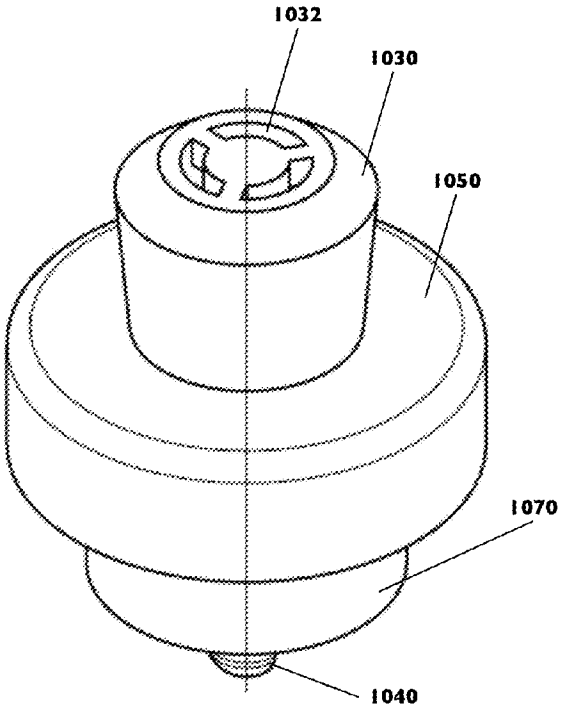
FIG. 10A shows a front perspective view of an exemplary cap 1080 comprising a mouthpiece 1030, middle section 1040, outer container base 1050, and inner container base 1060 with inner container connector 1070.

Referring to FIG. 10A, a front perspective view of an exemplary cap 1080 comprising a mouthpiece 1030, middle section 1040, outer container base 1050 and inner container base with connector 1070 is illustrated. As shown, each of the pieces may be connected or assembled in such a way as to allow the cap to be permanently or removably attached to a container comprising an inner container and outer container as described above. The mouthpiece 1030 is shown to comprise an aperture 1032 through which a first liquid and/or second liquid may be consumed by a user.

The mouthpiece 1030 is shown in a "closed" position, such that liquid may not pass through the aperture 1032. As discussed in detail below, the mouthpiece 1030 may be pulled by a mouth or fingers of a user into an "open" position to allow the passage of one or more liquids therethrough. That is, the mouthpiece 1030 may be extended away from the outer container base 1050 to allow liquid to flow, and may be pushed toward the base to stop the flow. In an alternative embodiment, the mouthpiece 1030 may be rotated or twisted to stop and start the flow of liquid.

Referring to FIG. 10B, an exploded view of the exemplary cap 1080 of FIG. 10A is illustrated. The cap may comprise a mouthpiece 1030, a middle section 1040, an outer container base 1050, an inner container base 1060, and an inner container attachment or connector 1070.

As shown, the mouthpiece 1030 may be shaped such that it may be placed in the mouth of a user. The mouthpiece 1030 may be connected to a middle section 1040 such that the two pieces form a single piece. In alternative embodiments, the mouthpiece 1030 and middle section 1040 may comprise separate pieces that may be connected by a connecting means.

As shown, the middle section 1040 may comprise a coaxial shape, with a cylindrical outer wall 1041 having a solid projection (i.e., plunger) 1043 extending therethrough to form a channel between the outer wall and plunger. The channel may be adapted to allow one or more liquids to pass therethrough. Accordingly, one or more liquids may pass from an inner or outer container (not shown) through the channel and into the mouthpiece 1030.

The plunger 1043 may comprise a solid shape, such as but not limited to a cylindrical shape, and may extend from the mouthpiece 1030, through the middle section channel, and extend a distance from a bottom of an outer wall 1041 defining the channel. The end of the plunger opposite the mouthpiece may terminate in an approximately half cylinder shape, such that one side may be curved 1046 and another side may be flat 1048. The plunger 1043 may be shaped such that, when the cap is assembled and secured to a container comprising an inner container and outer container, the plunger may extend a distance into the inner container.

The outer wall 1041 of the middle section 1040 may comprise one or more apertures, cutouts or windows 1042. As described in detail below, liquid from an outer container may pass through such aperture 1042 when the aperture is aligned with a complementary aperture 1052 in a base 1050. The middle section outer wall 1041 may be adapted to fit within a channel 1058 of an outer container base, such that a water-tight seal is formed between the two pieces. Accordingly, when the middle section aperture 1042 is not aligned with the outer container base aperture 1052, an outer container liquid may not pass through the middle section channel.

As shown, the outer container base 1050 may comprise a hollow cylindrical piece 1057 with a channel 1058 extending therethrough. The hollow cylindrical piece 1057 may be shaped such that, when the cap 1080 is attached to a container comprising an outer container and inner container, the cylindrical piece extends a distance into the outer container. An outer wall of the cylindrical piece 1057 may comprise one or more complimentary apertures 1052 to the middle section aperture(s) 1042, and the apertures may be located on the cylindrical piece 1057 that extends into an outer container. Accordingly, when an aperture 1052 of the cylindrical piece 1057 is aligned with a complementary middle section aperture 1042, liquid from an outer container may pass therethrough. However, when the outer container base aperture 1052 is not aligned with a complementary middle section aperture 1042, liquid may not pass from the outer container.

The outer container base 1050 may comprise a rim 1055 for attaching the base to a mouth of an outer container. Although not shown, the interior of the rim 1055 may comprise threads, a track, a snap fit, or other attachment means for attaching the outer container base to complementary attachment means of an outer container.

An inner container base 1060 may be displaced within the outer container base 1050 and may comprise a hollow cylindrical piece 1067 with a channel extending 1068 therethrough. The hollow cylindrical piece 1067 may be shaped such that, when the cap 1080 is attached to a container comprising an outer container and inner container, the cylindrical piece extends a distance into the inner container. A wall of the cylindrical piece may comprise an aperture 1062, and the aperture may be located on the cylindrical piece 1067 that extends into an inner container.

The cylindrical piece 1067 may be shaped such that it forms a liquid-tight seal with a plunger 1043 inserted or seated therein and an inner wall of the outer container base 1050. Accordingly, when an aperture 1062 of the cylindrical piece is aligned with the flat portion 1048 of the plunger 1043, liquid from an inner container may pass therethrough. However, when the curved side 1046 of a plunger 1043 is aligned with the aperture 1062 of the cylindrical piece 1067, liquid may not pass from the inner container.

The inner container base 1060 may comprise a snap-fit, threads or the like 1061 for removably or permanently connecting the same to a complementary snap-fit, threads or the like of an outer container base.

An inner container connector 1070 may comprise a rim for attaching the base to a mouth of an inner container. Although not shown, the interior of the rim may comprise threads, a track, a snap fit, or other attachment means for attaching the inner container connector 1070 and attached inner container base 1060 to complementary attachment means of an inner container. The inner container connector 1070 may also comprise projections 1074 for attaching the same to complementary attachment means (e.g. track) of an outer container base 1050. In one embodiment, the projections 1074 may at least partially cover the outer container base aperture 1052. In an alternative embodiment, the projections may instead be a snap fit, track, or threads for attaching the same to complementary attachment means (not shown) of an outer container base 1050.

The mouthpiece 1030, middle section 1040, outer container base 1050, inner container connector 1070 and inner container base 1060 may be permanently or removably attached to each other. Moreover, when the cap assembly 1080 is attached to an exemplary container comprising an inner container and outer container, the outer container base 1050 may be attached to a mouth of the outer container and the inner container base 1060 with inner container attachment 1070 may be attached to a mouth of an inner container.

In one embodiment, the aperture 1042 of the middle section 1040 may be located on a different vertical plane from the flat end 1048 of a plunger 1043. In other words, the middle section aperture 1042 may be located a certain horizontal distance from the plunger flat end 1048.

The middle section 1040 may be rotatably connected to the inner container base 1060, inner container connector 1070 and outer container base 1050, such that it may be rotated with respect to these pieces. Moreover, the outer container base 1050, inner container base 1060 and inner container connector 1070 may not be rotatable with respect to each other. Accordingly, a user may choose to drink an inner container liquid or outer container liquid by rotating the mouthpiece 1030 (connected to the middle section 1040) with respect to the stationary outer container base, inner container base, and inner container connector.

For example, a user desiring to drink a liquid from the inner container may rotate the middle section such that the flat end of the plunger is aligned with an aperture in the inner container base. In this configuration, the middle section aperture 1042 may not be aligned with the outer container base aperture 1052, and liquid may not flow from the outer container.

As another example, a user desiring to drink a liquid from an outer container may rotate the middle section 1040 such that the aperture 1042 is aligned with an aperture 1052 in the outer container base 1050. In this configuration, the curved end of the plunger 1046 covers the aperture 1062 in the inner container base 1060, and liquid may not flow from the inner container.

Figure 10C:
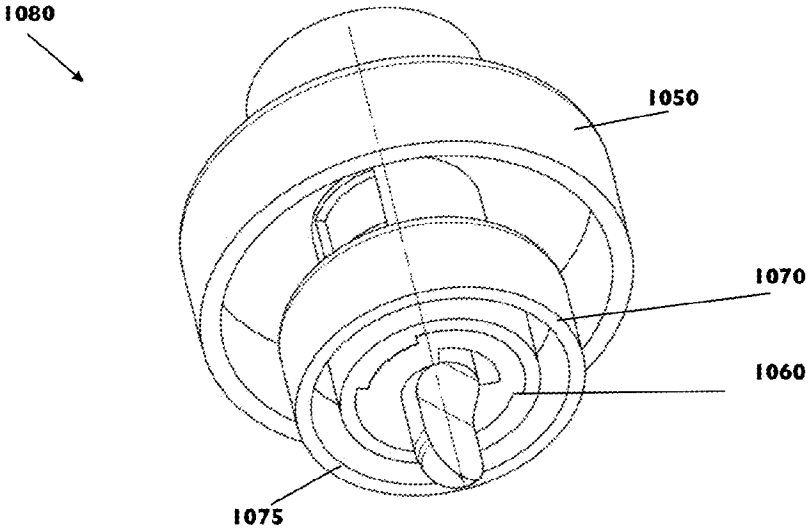
FIG. 10C shows a bottom perspective view of the exemplary cap 1080 of FIG. 10A.

Referring to FIG. 10C, a bottom perspective view of the exemplary cap 1080 of FIG. 10A is illustrated. As shown, the outer container base 1050 may be closed off by the outer wall of the middle section 1040, when the middle section aperture 1042 is not aligned with the aperture 1052 of the outer container base 1050. Accordingly, liquid from an outer container may not pass through the outer container base.

The outer container base 1050 may comprise a rim 1055 for attaching the base to a mouth of an outer container. Although not shown, the interior of the rim may comprise threads, a track, a snap fit, or other attachment means for attaching the outer container base to complementary attachment means of an outer container.

An inner container connector 1070 may comprise a rim 1075 for attaching the base to a mouth of an inner container. Although not shown, the interior of the rim 1075 may comprise threads, a track, a snap fit, or other attachment means for attaching the inner container base to complementary attachment means of an inner container.

Figure 11C:
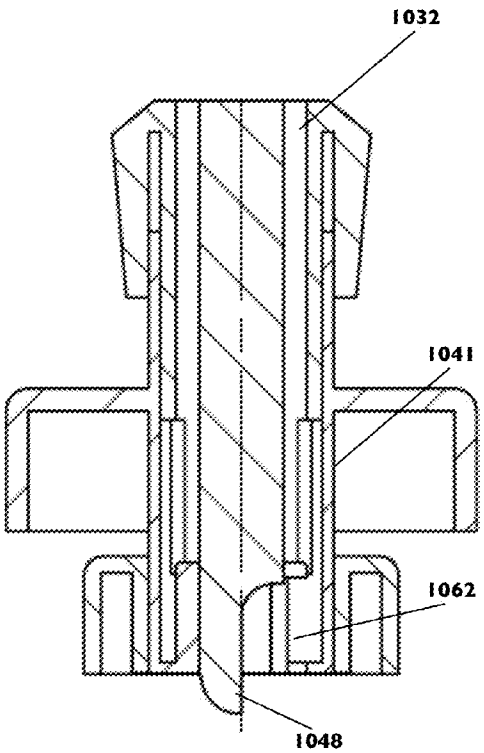
FIG. 11C shows a cross-sectional view of the exemplary cap 1080 of FIG. 10A, where a mouthpiece 1030 is in an open position, an inner container base aperture 1062 is open, and outer container base aperture(s) (not shown) are blocked by an outer wall 1041 of a middle section 1040.
Figure 11B:
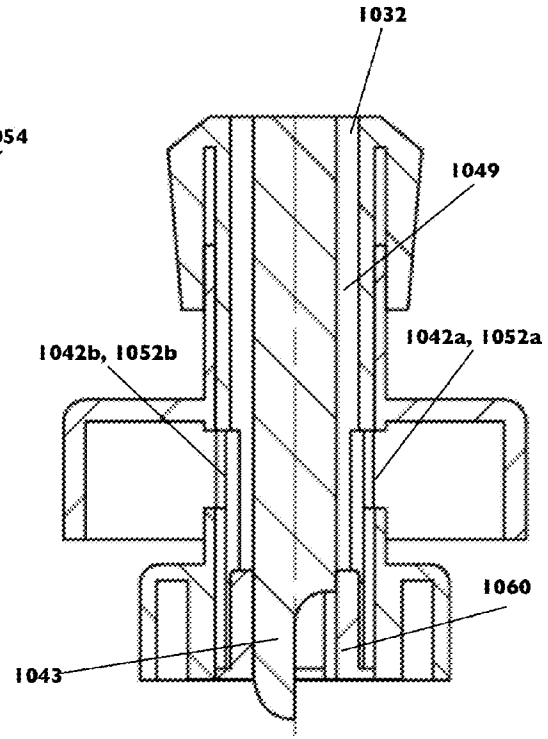
FIG. 11B shows a cross-sectional view of the exemplary cap 1080 of FIG. 10A, where a mouthpiece 1030 is in an open position, an inner container base aperture (not shown) is blocked by a plunger 1043, and an outer container base aperture 1042*a,b* is open, therefore allowing the flow of an outer container liquid through the mouthpiece.
Figure 11A:
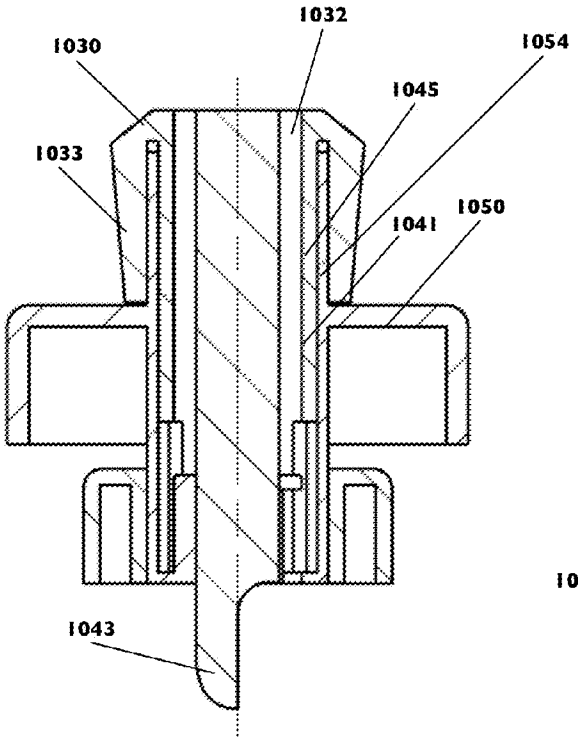
FIG. 11A shows a cross-sectional view of the exemplary cap 1080 of FIG. 10A, where a mouthpiece 1030 is in a closed position, an inner container base aperture (not shown) is blocked by a plunger 1043 and an outer container base aperture (not shown) is blocked by an outer wall 1041 of a middle section 1040.

Referring to FIG. 11A, a cross-sectional view of the exemplary cap 1080 of FIG. 10A is illustrated, where a mouthpiece 1030 is in a closed position, an inner container base aperture (not shown) is blocked by a plunger 1043 and an outer container base aperture (not shown) is blocked by an outer wall 1041 of a middle section 1040.

As shown, the mouthpiece 1030 comprises a rim 1033 such that it may be attached or connected to a wall 1054 of the outer container base 1050 in such a way as to allow the mouthpiece to be pulled up or pushed down with respect to the outer container base. The mouthpiece is shown in a downward or closed position, such that the mouthpiece aperture 1032 is blocked.

Although not shown, upon shipment of an exemplary container, a protective seal (e.g., foil or plastic) may be employed between the bottom of the plunger 1043 and the top of the mouth of an inner container. A user wishing to "open" the bottle may push the mouthpiece 1030 downward, causing the plunger 1043 to pierce the protective seal and provide access to any liquid container within the inner container.

Referring to FIG. 11B, a cross-sectional view of the exemplary cap 1080 of FIG. 10A is illustrated, where a mouthpiece 1030 is in an open position, an inner container base aperture (not shown) is blocked by a plunger 1043, and an outer container base aperture 1052*a,b* is open, therefore allowing the flow of an outer container liquid through the mouthpiece.

As shown, the mouthpiece 1030 has been pulled-up from the state depicted in FIG. 11A, and the mouthpiece aperture 1032 is open. The middle section apertures 1042*a,b* are shown to be aligned with the outer container base apertures 1052*a,b* and liquid contained in an outer container is free to flow into the middle section channel 1049 and out through the mouthpiece aperture 1032. The plunger 1043 is shown to be flush against the inner container base 1060, and so liquid from the inner container may not pass through the inner container base aperture (not shown) into the middle section channel 1049.

Referring to FIG. 11C, a cross-sectional view of the exemplary cap 1080 of FIG. 10A is illustrated, where a mouthpiece 1030 is in an open position, an inner container base aperture 1062 is open, and an outer container base aperture (not shown) is blocked by an outer wall 1041 of a middle section 1040.

As shown, the mouthpiece 1030 has been pulled-up from the state depicted in FIG. 11A, and the mouthpiece aperture 1032 is open. The flat side 1048 of the plunger is aligned with the inner container base aperture 1062, and so liquid in an inner container may pass through the aperture 1062, through the middle section channel 1049 and out through the mouthpiece aperture 1032. The middle section apertures 1042*a,b* are not aligned with the outer container base apertures (not shown) and liquid contained in an outer container may not flow into the middle section channel 1049.

The invention described and claimed herein is not to be limited in scope by the specific embodiments herein disclosed since these embodiments are intended as illustrations of several aspects of the invention. Any equivalent embodiments are intended to be within the scope of this invention. Indeed, various modifications of the invention in addition to those shown and described herein will become apparent to those skilled in the art from the foregoing description. Such modifications are also intended to fall within the scope of the appended claims. All publications cited herein are incorporated by reference in their entirety.

We claim:

1. A container comprising:

an outer chamber adapted to hold an amount of a first liquid;

an inner chamber displaced within the outer chamber, the inner chamber adapted to hold an amount of a second liquid; and a cap comprising:

a mouthpiece adapted to allow the first liquid and second liquid to flow therethrough;

a middle section having an open top end fixed to the mouthpiece, a closed bottom end, and a hollow wall extending from the top end to the bottom end to define a channel, wherein the middle section wall comprises an aperture located between the top end and the bottom end thereof, the aperture adapted to allow a liquid to pass through the middle section channel to reach the aperture of the mouthpiece; and a base attached to the inner chamber, the base adapted to receive at least a portion of the middle section therein such that the middle section and mouthpiece may move vertically with respect to the base and the inner chamber, wherein the cap is adapted to allow passage of the first liquid, but not the second liquid, when the mouthpiece and middle section are in a first vertical position, and wherein the cap is adapted to allow passage of the second liquid, but not the first liquid, when the mouthpiece and middle section are in a second vertical position.

* * * * *